United States Patent [19]

Wise et al.

[11] Patent Number: 5,027,807

[45] Date of Patent: Jul. 2, 1991

[54] PROTECTIVE GARMENT COOLING DEVICE

[75] Inventors: Layton A. Wise, Washington; David G. Aaron, Monroeville, both of Pa.

[73] Assignee: Mine Safety Appliances Company, Pittsburgh, Pa.

[21] Appl. No.: 428,187

[22] Filed: Oct. 27, 1989

[51] Int. Cl.[5] ..... H62B 17/00

[52] U.S. Cl. ..... 128/201.28; 128/201.29; 128/205.24

[58] Field of Search ..... 128/201.29, 201.28, 128/205.24, 205.11

[56] References Cited

U.S. PATENT DOCUMENTS

| | | | |
|---|---|---|---|
| 4,271,833 | 6/1981 | Moretti | 128/201.29 |
| 4,489,721 | 12/1984 | Ozaki et al. | 128/205.24 |
| 4,738,119 | 4/1988 | Zafred | 128/400 |
| 4,881,539 | 11/1989 | Pasternack | 128/201.29 |

*Primary Examiner*—Clifford D. Crowder
*Assistant Examiner*—Stephen R. Funk
*Attorney, Agent, or Firm*—Reed Smith Shaw & McClay

[57] ABSTRACT

A protective garment or suit made of fluid impermeable material for use by workers in toxic and hostile environments having an air cooling deivce that divides air from a single airline supply into two separate fractions, one to provide respiratory air at the proper volume and pressure to a breathing mask and the other to provide cooling air at the proper volume and pressure to the inside of the suit to cool the body of the worker. The cooling device permits the delivery of different volumes of cooling air and respiratory air at the appropriate pressure. Further, the volumetric flow of respiratory air to the breathing mask can be adjusted by the worker while preventing it from being reduced below a predetermined safe minimum volumetric flow.

10 Claims, 3 Drawing Sheets

PROTECTIVE GARMENT COOLING DEVICE

FIELD OF THE INVENTION

The present invention relates generally to protective garment cooling devices for use by workers in areas having hostile or toxic atmospheres containing airborne irritants, and more particularly to protective garment cooling devices using an external supply of air to provide the required cooling.

BACKGROUND OF THE INVENTION

Workers that must perform a task in an environmentally unsafe area, such as Hazmat cleanup or asbestos removal, must wear garments that protect both the worker's skin and respiratory tract. Garments for protecting workers from exposure in toxic or hazardous environments typically include a total encapsulating suit to isolate the worker's body and a hood and breathing mask to isolate the worker's respiratory tract from the toxic agents in the hostile environment. The suits are normally constructed of a fluid impermeable material made from a variety of different plastics. Since the suits are impermeable to fluids, they do not "breathe" (i.e., do not allow air to pass through the suit material). As a result, the interior of the suit becomes quite warm and uncomfortable for the wearer while he is working.

Any encapsulating suit that is impermeable to a fluid, must be worn with some type of respiratory air supply. The respiratory air supply can be either self-contained or externally provided by an airline to a breathing mask inside of the suit. A suit and breathing mask using an external respiratory air supply is shown in the MSA brochure entitled "Constant, Flow or Pressure Demand Duo-Flo and Duo-Twin Respirators" (10-01-14).

Often, these encapsulating suits will also use an external air supply to provide air circulation to the interior of the suit and thereby provide cooling to the suit and the worker. U.S. Pat. Nos. 3,777,750; 4,271,833 and 4,458,680 are examples of such suits. In suits such as these, the cooling air provided to the interior of the suit is also used for breathing by the worker since no separate air supply is provided. The disadvantage with this arrangement, however, is that the worker is breathing a mixture of used air (i.e., exhaled air containing $CO_2$) and fresh air (from the air supply) in the suit rather than breathing clean fresh air directly from the air supply.

To overcome this disadvantage, some suits that provide respiratory air by an airline, such as those used in the asbestos removal industry, are normally cooled by a separate airline that blows cooling air directly into the interior of the suit. As a result, the worker does not breathe the cooling air. These suits, however, must be connected to two separate airlines, one that supplies breathing air at a given volume and pressure to the breathing mask and the other one that supplies cooling air at a different volume and pressure to the interior of the suit.

Since the suit is connected to two separate airlines, the worker's mobility and dexterity is greatly limited. The weight of the suit is also dramatically increased by the addition of the second airline. As a result, the worker must contend with reduced movement as well as excess weight while already performing tasks in an uncomfortable and hazardous environment.

The worker is further limited in his ability to enter or exit the work environment due to the weight and constrictions of the two airlines. Because of these added restrictions placed on the worker, the worker's productive time inside the hostile work environment is reduced. Additionally, the necessity for two airlines can be dangerous to workers who must be able to climb or run in making a quick escape from a hazardous area.

There is a need, therefor, for a totally encapsulating suit which has a cooling device that both supplies respiratory air directly to the worker through his breathing mask and also supplies cooling air to the interior of the suit while requiring only a single airline from an external air supply. By using a single airline from one external air supply, the worker's mobility is greatly increased and the stress and fatigue associated with transporting the extra weight of a second airline is eliminated.

SUMMARY OF THE INVENTION

Generally, the present invention relates to a cooling device used with a protective garment or suit by workers to protect themselves from exposure to toxic environments and particularly those associated with Hazmat cleanup or asbestos removal. The suit is comprised of a fluid impermeable material made from a variety of different plastics for protecting the worker's skin. Typically, it includes a hood and a breathing mask for protecting the worker's respiratory tract. A single external air supply is connected, preferably by a flexible hose, to a cooling device which divides the air flow into a first portion or fraction which is provided directly to the breathing mask (respiratory air) through a second flexible hose, and a second portion or fraction which is provided directly to the interior of the suit (cooling air) to provide cooling for the worker's body.

The cooling device comprises a valve assembly which has an inlet through which air is provided at a given volume and pressure from the external air supply, and two outlets, the first outlet for providing respiratory air at a predetermined volume and pressure to the breathing mask for respiration and the second outlet for providing cooling air at a second predetermined volume and pressure to the suit for cooling. Preferably, a plurality of orifices and chambers connect the inlet to the two respective outlets to provide the desired volumetric flow rates to the breathing mask and the suit at the appropriate pressure. In one embodiment, the cooling device also comprises a vortex tube for further cooling the air before it is provided to the suit. The vortex tube is connected between the valve assembly and the suit to provide even cooler air to the suit.

The cooling device of the present invention can be used in conjunction with other safety devices. For example, a secondary breathing device may be connected between the cooling device and the breathing mask to enable the worker to automatically breathe through the secondary breathing device in the event the external air supply should fail. Similarly, a quick escape mechanism can be connected between the cooling device and the suit. In an emergency, the air supply to the suit can quickly be disconnected.

In one embodiment, the valve assembly includes a valve body comprising a first chamber and an inlet for providing air from an air supply to the first chamber; a first outlet for providing air to a breathing mask; a first orifice connecting the first outlet and the first chamber; a second outlet for providing cooling air to a protective suit; and a second orifice connecting the second outlet to the first chamber.

The first chamber and the inlet can be coextensive. Similarly, both outlets may be connected to chambers which are in turn connected by the respective orifices to the first chamber. Preferably, an adjustment means is provided by which the flow of air to either the breathing mask or the suit, or both, can be adjusted without reducing the air flow to the breathing mask below a predetermined, acceptable minimum level. Preferably, more than one orifice connects the first outlet to the first chamber with one orifice being unrestricted to maintain a minimum required volumetric flow of respiratory air while the second orifice can be controlled by the adjustment means.

Other details, objects and advantages of the present invention will become apparent as the following description of the presently preferred embodiments of practicing the invention proceeds.

BRIEF DESCRIPTION OF THE DRAWINGS

In the accompanying drawings, the preferred embodiments of the invention and preferred methods of practicing of the invention are illustrated wherein.

DETAILED DESCRIPTION OF THE INVENTION

Figure 1:
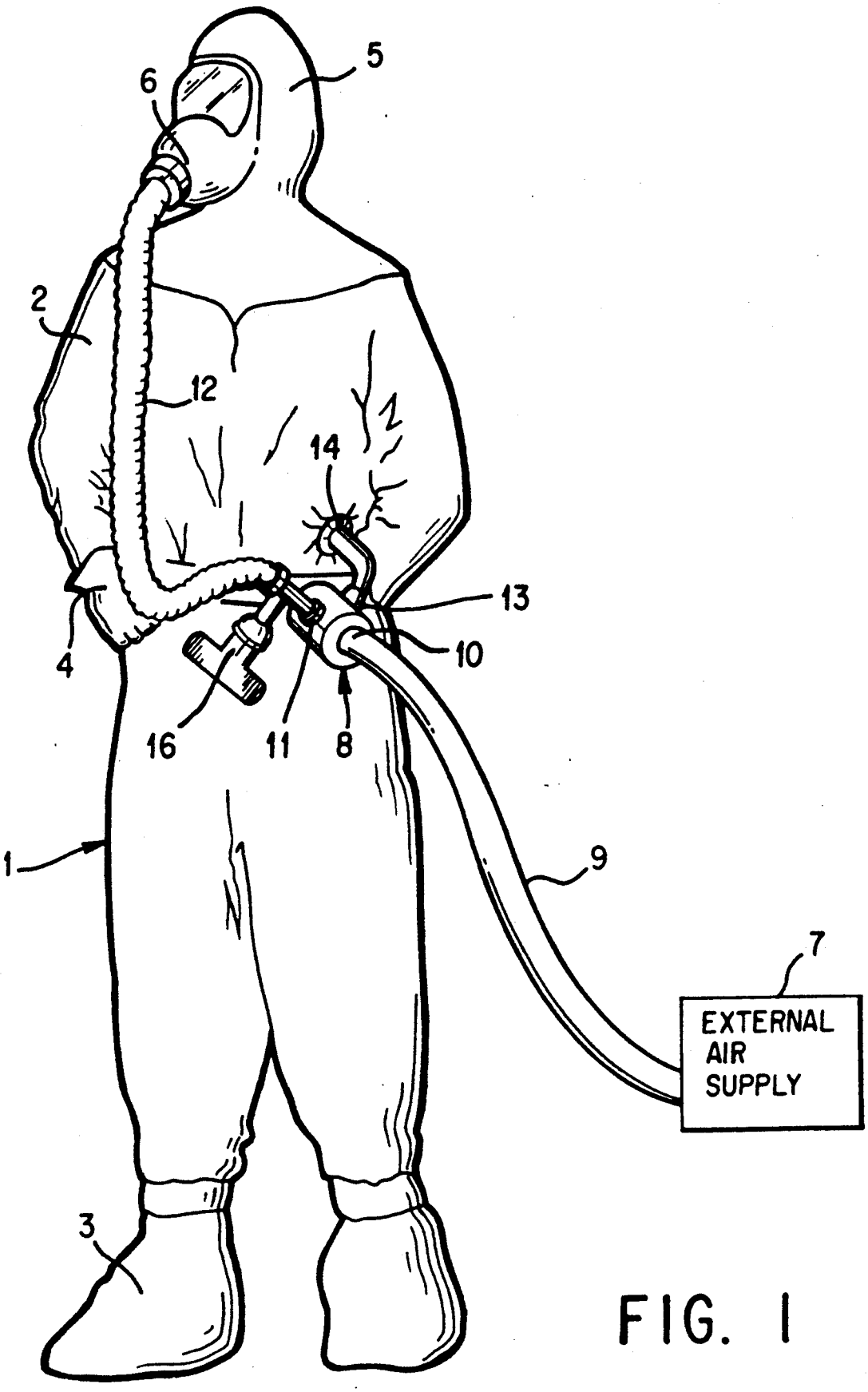
FIG. 1 shows a protective garment utilizing a cooling device of the present invention.

FIG. 1 shows a worker in a protective suit 1 which is impermeable to fluids. The suit totally encloses the worker and includes a suit body 2, boots 3, gloves 4, a hood 5 and a breathing mask 6. The suit shown in FIG. 1 utilizes a single external air supply 7 to provide- both respiratory air for the worker's lungs and cooling air for the worker's body. The cooling device 8 of the present invention is connected to the external air supply 7 by means of a neoprene hose 9. The neoprene hose 9 is connected to an inlet 10 of the cooling device 8.

The cooling device 8 has two outlets, a first outlet 11 which is connected to the breathing mask 6 through a hose 12, and a second outlet 13 which is connected to the interior of the suit by another hose 14. While the connection to the suit is shown at chest level, it would be evident to one skilled in the art that this connection could be made anywhere on the suit including the back of the suit body 2 or on the hood 5.

Figure 2:
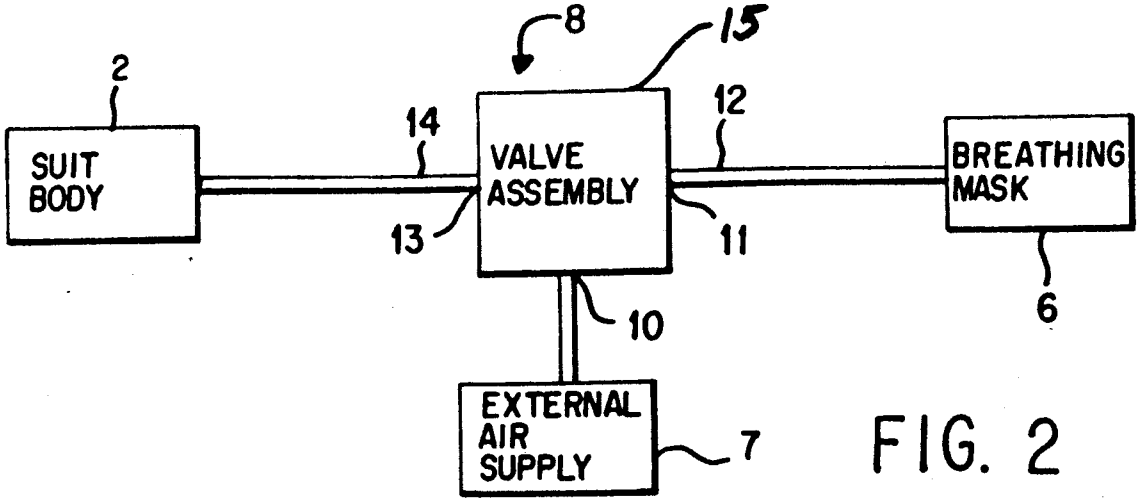
FIG. 2 is a block diagram of one embodiment of the cooling device.

Preferably, the cooling device 8 comprises a valve assembly 15 as shown in FIG. 2. The connections shown in FIG. 2 are similar to those shown in FIG. 1. Additionally, FIG. 1 shows a secondary breathing device 16 connected between the valve assembly 15 and the breathing mask 6 which serves as a backup breathing system in case the air from the external air supply 7 is cut-off for some reason. With the secondary breathing device 16, the worker can still obtain respiratory air by breathing through the secondary breathing device 16. Examples of secondary breathing devices are the Duo-Flo Pressure Demand Respirator and the Duo-Twin Pressure Demand Respirator described in the MSA brochure mentioned previously.

Figure 3:
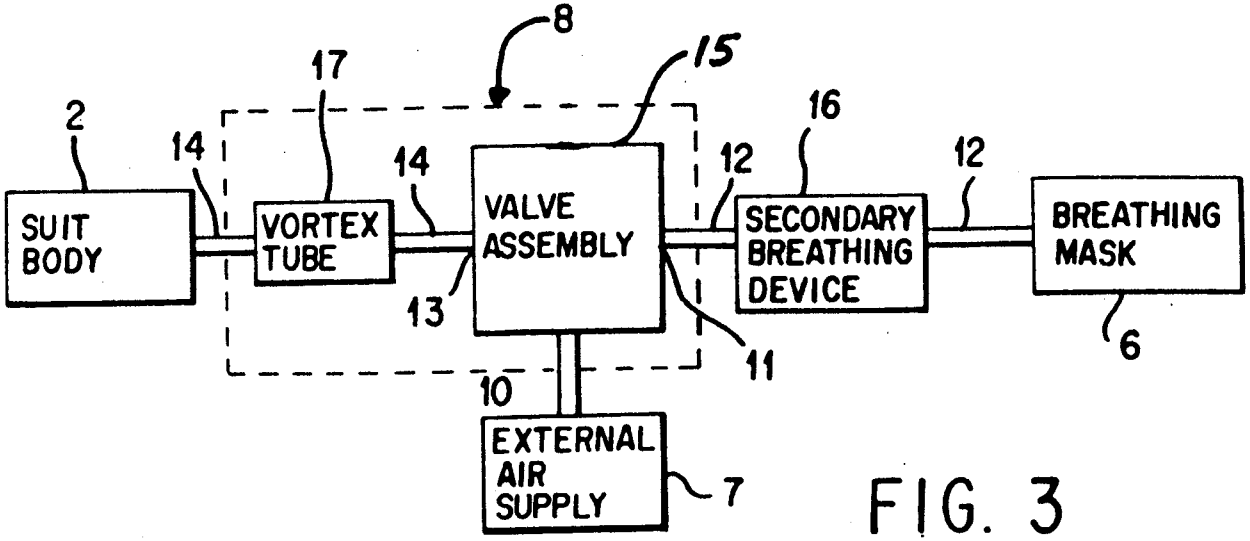
FIG. 3 is a block diagram of a second embodiment of the cooling device.

As shown in FIG. 3, a vortex tube 17 can form part of the cooling device 8 and can be connected between the valve assembly 15 and the interior of the suit. The vortex tube provides further cooling to the cooling air prior to its entering the suit body 2. Many different vortex tubes can be used in the present invention. U.S. Pat. Nos. 2,893,215; 3,214,923; and 4,240,261 disclose such vortex tubes. Additionally a muffler can be used in connection with the cooling air to the suit.

Figure 4:
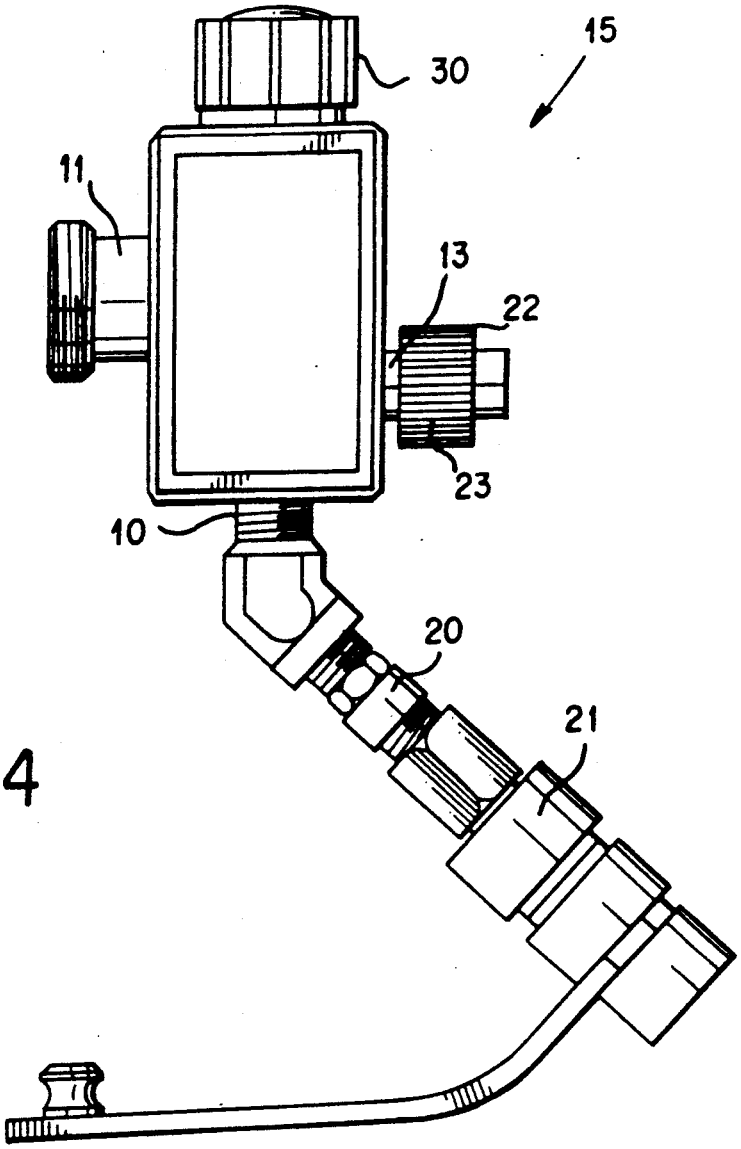
FIG. 4 shows one embodiment of the valve assembly of the cooling device.

FIG. 4 shows one embodiment of a valve assembly 15 used in the cooling device 8 of the present invention. Preferably, the valve assembly 15 comprises a valve body 18 having an inlet 10 from the external air supply 7, a first outlet 11 connected to the breathing mask 6, and a second outlet 13 connected to the suit for cooling. Preferably, an adjustment means 19 is also included in the valve body 18 for adjusting the volumetric flow of the respiratory air to the breathing mask 6. Preferably, the air from the external air supply 7 passes through a disc filter 20 and a screen filter 21 before entering the inlet 10 of the valve body 18. In one embodiment, a quick disconnect device 22 is connected between the hose to the suit and the second outlet 13. This enables the cooling air to the suit to be quickly disconnected from the valve assembly 15 in an emergency situation. Preferably, this quick disconnect device 22 includes a check valve 23.

Figure 5:
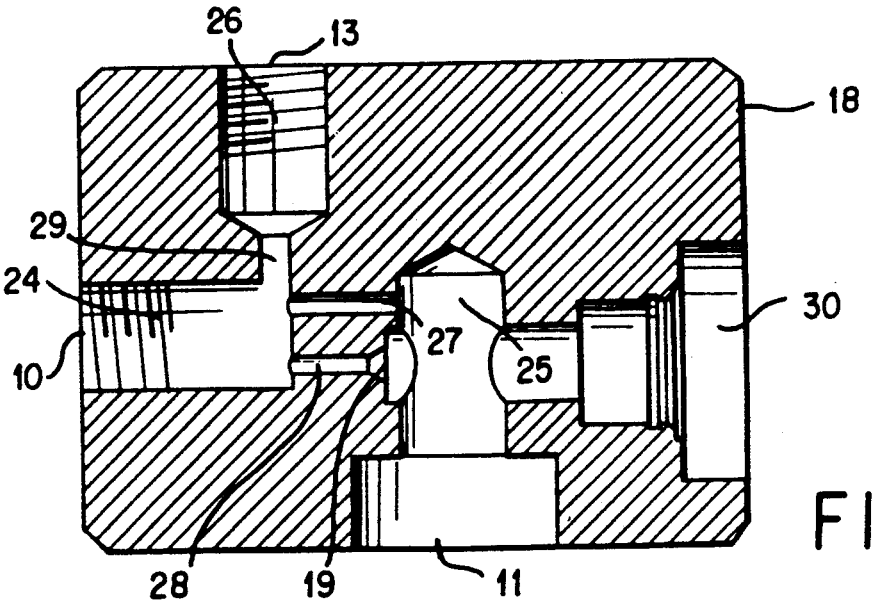
FIG. 5 is a sectional view of the valve body portion of the valve assembly shown in FIG. 4.

As shown in FIG. 5, the valve body 18 preferably comprises a plurality of chambers and orifices. The inlet from the external air supply 7 passes into a first chamber 24. The first chamber is connected by a first orifice 27 to a second chamber 25. The second chamber 25 is connected to the first outlet 11 which goes to the breathing mask 6. The first orifice 27 is unrestricted and is designed such that it permits a fixed volumetric flow of respiratory air to pass from the first chamber 24 into the second chamber 25 at a given pressure. For typical operations of these type of devices, the air at the inlet 10 is at a pressure of 80–100 psig. The first orifice is preferably sized such that it permits 4 CFM to pass from the first chamber 24 into the second chamber 25 and thus to the breathing mask 6.

Preferably, a second orifice 28 also connects the first chamber 24 to the second chamber 25. The second means 19 which can adjust the volumetric flow therethrough. The adjustment means 19 is connected to an adjustment knob 30 which can be seen more clearly in FIG. 4. Preferably, the second orifice 28 is sized to permit a volumetric flow of between 0 CFM, when it is closed, and 11 CFM, when it is completely open. This enables the worker, by turning the adjustment knob 30, to control the volumetric flow of respiratory air to the breathing mask 6 and vary it anywhere from 4 CFM to 15 CFM.

A third orifice 29 connects the first chamber 24 to a third chamber 26. The third chamber is connected to the second outlet 13. The third orifice 29 is sized so as to provide up to about 20 CFM to the suit, depending upon whether additional devices including a muffler are used. If compressed air is provided by the air supply, it may provide sufficient cooling by itself. If not, however, a vortex tube 17 can be connected to the valve assembly 15 of FIG. 4 to comprise one embodiment of the cooling device 8 of the present invention. The operation of a vortex tube 17 would be known by one skilled in the art, especially with reference to the previously mentioned patents.

In one embodiment, the first chamber 24 can be coextensive with the inlet 10, the second chamber 25 can be coextensive with the first outlet 11 and the third chamber 26 can be coextensive with the second outlet. Alternatively, each chamber may be distinct from its corresponding inlet or outlet as long as it is connected thereto.

While a presently preferred embodiment of practicing the invention has been shown and described with particularity in connection with the accompanying drawings, the invention may otherwise be embodied within the scope of the following claims.

What is claimed is:

1. A protective garment cooling device comprising: a valve assembly capable of being connected to a single external air supply and having separate outlets, for providing both a flow of respiratory air to a user and a flow of cooling air to a protective garment, means for providing the flow of respiratory air to the user substantially independent of the flow of cooling air to the protective garment; said means including in the valve assembly a first chamber having an inlet capable of being connected to the single external air supply; a second chamber having a first outlet for providing a flow or respiratory air to the user; a third chamber having a second outlet for providing a flow of cooling air to the protective garment; a first orifice connecting the first chamber to the second chamber; and a third orifice connecting the first chamber to the third chamber.

2. A protective garment cooling device as described in claim 1 wherein a second orifice connects the first chamber to the second chamber, the first orifice being fixed and unrestricted and the second orifice being adjustable so that the flow of respiratory air from the first chamber to the second chamber can be varied within a fixed range.

3. A protective garment cooling device as described in claim 2 wherein the first, second and third chambers are coextensive, respectively, with the inlet, the first outlet and the second outlet.

4. A protective garment cooling device as described in claim 1 further comprising a vortex tube connected to the second outlet for providing additional cooling to the flow of cooling air to the protective garment.

5. A protective garment cooling device as described in claim 1 further comprising a secondary breathing device connected to the first outlet.

6. In an encapsulating protective garment for use in toxic and hazardous environments including a suit body, a hood, gloves and boots, all made of a fluid impermeable material, and also including a breathing mask, a single external air supply and a cooling device, the cooling device being connected to the external air supply by a single hose and having separate outlets for providing a flow of respiratory air to the breathing mask and a flow of cooling air to the protective garment, the improvement including means for providing the flow of respiratory air to the user substantially independent of the flow of cooling air to the protective garment said means including a first chamber having an inlet connected to the hose; a second chamber having a first outlet for providing the flow of respiratory air to the breathing mask; a third chamber having a second outlet for providing the flow of cooling air to the protective garment; a first orifice connecting the first chamber to the second chamber; and a third orifice connecting the first chamber to the third chamber.

7. In an ecapsulting protective garment as described in claim 6 wherein a second orifice connects the first chamber and the second chamber in the cooling device, the first orifice being fixed and unrestricted and the second orifice being adjustable so that the flow of respiratory air from the first chamber to the second chamber can be varied within a fixed range.

8. In an encapsulating protective garment as described in claim 6 wherein the first, second and the third chambers of the cooling device are coextensive, respectively, with the inlet, the first outlet and the second outlet.

9. In an encapsulating protective garment as described in claim 6 wherein the cooling device further comprises a vortex tube connected to the second outlet for providing additional cooling to the flow of cooling air to the protective garment.

10. In an encapsulating protective garment as described in claim 6 further comprising a secondary breathing device connected between the first outlet and the breathing mask.

* * * * *